United States Patent [19]

Rader, Jr.

[11] 4,446,884

[45] May 8, 1984

[54] TAKE-UP REEL WITH CONTROLLED REWIND VELOCITY

[76] Inventor: Homer J. Rader, Jr., 10035 Surrey Oaks, Dallas, Tex. 75229

[21] Appl. No.: 541,296

[22] Filed: Oct. 12, 1983

Related U.S. Application Data

[63] Continuation of Ser. No. 271,555, Jun. 8, 1981, abandoned.

[51] Int. Cl.[3] ..... B65H 75/48

[52] U.S. Cl. ..... 137/355.23; 242/107.3; 242/99; 242/86; 137/355.26; 137/580

[58] Field of Search ..... 242/107.3, 99, 86; 254/377; 188/290; 137/355.16, 355.17, 355.18, 355.19, 355.2, 355.21, 355.22, 355.23, 355.26, 355.27, 580

[56] References Cited

U.S. PATENT DOCUMENTS

| | | | |
|---|---|---|---|
| 2,077,080 | 4/1937 | Tolman | 188/290 |
| 2,358,096 | 9/1944 | Peterson | 254/377 X |
| 2,584,559 | 2/1952 | Dalrymple | 242/107.3 X |
| 2,923,549 | 2/1960 | Hopper et al. | 188/290 X |
| 3,211,396 | 10/1965 | McQuillen | 188/290 X |
| 3,879,016 | 4/1975 | Kankkunen | 242/107.3 X |
| 3,907,079 | 9/1975 | Chapman | 188/290 |

*Primary Examiner*—John M. Jillions
*Attorney, Agent, or Firm*—Dennis T. Griggs

[57] ABSTRACT

A take-up reel for storing and paying out an elongated flexible member such as a cable, rope, hose or the like features viscous damped rewind action which reduces shock loads on the hose and associated equipment. A viscous damper is coupled to the take-up reel assembly and limits the rewind velocity so that the hose can be released for free rewind without undergoing excessive shock. In a preferred embodiment, the viscous damping action is provided by a stator disc which is enclosed within an annular damper housing carried by the rotor of the take-up reel assembly.

6 Claims, 4 Drawing Figures

TAKE-UP REEL WITH CONTROLLED REWIND VELOCITY

This application is a continuation of application Ser. No. 271,555, filed June 8, 1981, now abandoned.

BACKGROUND OF THE INVENTION

1. Field of the Invention

The present invention relates to take-up reels of the type for storing and paying out an elongated, flexible member such as a cable, rope, hose or the like, and which automatically rewinds the flexible member when it is released.

2. Description of the Prior Art

There are several applications in which a flexible member such as a lift cable, rope, hose, electrical cable, extension cord, grounding cord or the like is wound about a take-up reel for storage when not in use, and which is payed out by unwinding from the take-up reel to the appropriate length as required. An important application of this arrangement is the use of a flexible hose for carrying air, water, oil, grease, and the like from a reservoir to a dispensing nozzle. For example, in the typical automobile service station, air is delivered from a compressor tank through a long tubular hose which is wound around a spring-loaded take-up reel. The air hose is pulled from the reel for use, and at the same time rewind energy is stored in the wind-up spring motor. The wind-up spring motor rewinds the hose onto the reel when the hose is released.

The rewind action accelerates as more and more of the hose is taken up, with the result that the terminal velocity of the hose is quite high and can cause damage to the rewind mechanism or to itself because of the high shock loading which arises. The whipping action which occurs as a result of the uncontrolled rewinding can cause property damage and personal injury. Moreover, during such uncontrolled rewinding, the rapidly rotating reel with its rotational inertia gradually increasing as more and more of the cable is recovered can overrun the spring motor and reverse wind the spring thereby causing deformation or breakage of the spring.

Various braking devices have been proposed for automatically limiting the rewind rate of the take-up reel. In one such arrangement, the movement of a piston which is coupled to the rewind reel is retarded by a volume of liquid which is contained within a cylinder and which is discharged through a flow restriction in response to movement of the piston. Such arrangements have found only limited acceptance because of the interference of the piston at low rewind velocity.

OBJECTS OF THE INVENTION

It is, therefore, the principal object of the present invention to provided a take-up reel assembly suitable for use with a flexible member such as a cable, rope, hose or the like, in which the flexible member can be released for free rewind without causing excessive shock.

Another object of the invention is to provided a damper for a take-up reel assembly in which the retarding force automatically increases as a function of rewind velocity, thereby allowing relatively free, unrestrained rotation at relatively low rewind velocity, but substantially limiting rewind rotation at high velocities.

A further object of the invention is to provide a compact, viscous damper assembly which can be installed in combination with an existing take-up reel assembly without substantial structural modification.

A related object of the invention is to provide a take-up reel having a viscous damper for controlled rewind velocity in which the components are easily assembled or disassembled.

SUMMARY OF THE INVENTION

The foregoing objects are achieved in the present invention by a damper assembly which is interposed between the support shaft of a take-up reel assembly and the take-up reel in which a viscous fluid is sheared by a fixed stator member in response to rotation of the take-up reel. In a preferred embodiment, the damper assembly includes a damper housing secured to the rotor of the take-up reel in which an annular chamber is formed concentric with a support shaft. A stator disc is secured to the shaft and is received within the annular damper chamber. A volume of viscous fluid is sealed within the chamber by a rotary fluid seal which is coupled between the rotor and the shaft. Shear forces which arise in response to rotation of the take-up reel assembly increase directly in proportion to the relative velocity of the rotor and stator surfaces. Therefore, as the rewind velocity increases, the retarding force also increases, which stabilizes the rotation of the take-up reel and limits its terminal velocity.

For retrofit purposes, the damper assembly preferably comprises a damper housing having an annular back plate attached to the rotor in concentric relation with the support shaft, an annular cover plate mounted onto the back plate with one of the plate members having a large annular counterbore disposed in concentric relation with the shaft to define the damper chamber. Preferably, the stator member is an annular disc which is concentrically mounted on the shaft and which is axially spaced between the back plate and the cover plate. In this arrangement, the surface area in contact with the fluid is maximized, thereby providing a compact, modular assembly.

The novel features which characterize the invention are defined by the appended claims. The foregoing and other objects, advantages and features of the invention will hereinafter appear, and for purposes of illustration of the invention, but not of limitation, an exemplary embodiment is shown in the appended drawings.

DESCRIPTION OF THE PREFERRED EMBODIMENT

Figure 1:
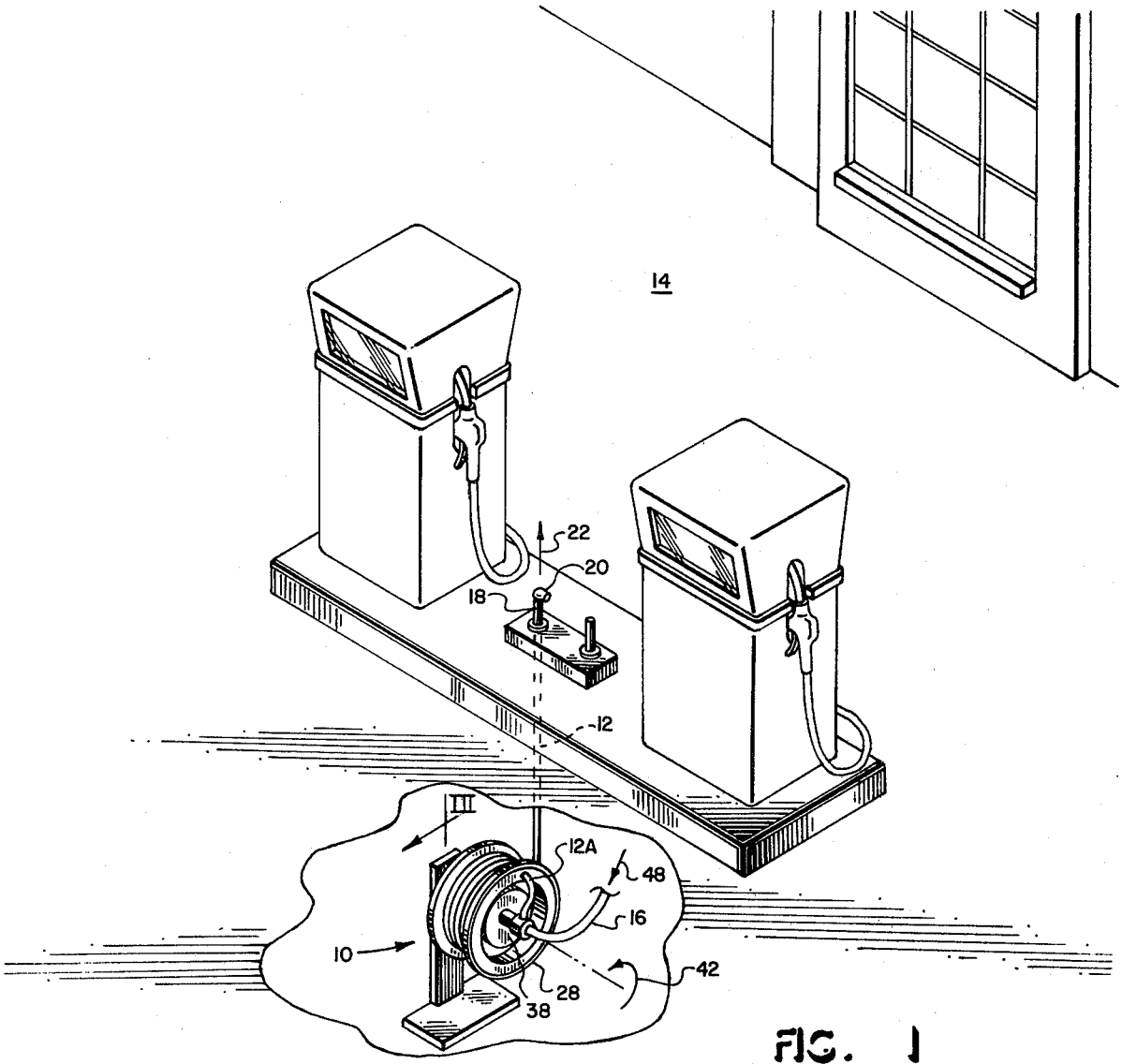
FIG. 1 is a perspective view of a typical application of the invention for a high pressure air hose in a service station.

In the description which follows, like parts are marked throughout the specification and drawings with the same reference numerals respectively. The drawings are not necessarily to scale and in some instances portions have been exaggerated in order to more clearly depict certain features of the invention.

Referring now to FIG. 1, a take-up reel assembly 10 having a viscous damper according to the present invention is illustrated, by way of example, as used for paying out and taking up a length of high pressure air hose 12 in a service station facility 14. In this arrangement, high pressure air is delivered from a compressor (not illustrated) through an underground conduit 16 to the take-up reel assembly 10. The terminal end 18 of the air hose 12 is fitted with a delivery valve assembly 20 in the usual manner. When it is desired to provide high pressure air service, the delivery valve assembly 20 is lifted upwardly as indicated by the arrow 22, with the result that a desired length of the air hose 12 can be pulled from the take-up reel assembly 10 to service a nearby automobile. According to common practice, a wind-up spring 24 (FIG. 4) provides a continuous rewind bias force on the take-up reel assembly, with the result that a constant pulling force of retraction is applied to the air hose 12.

Figure 4:
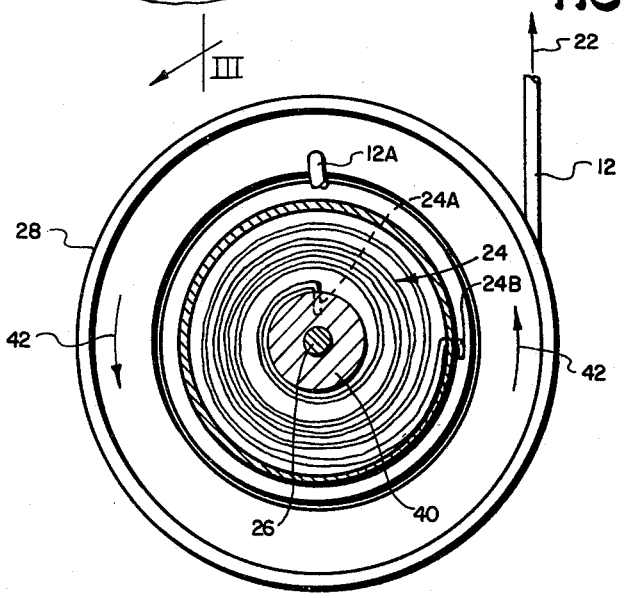
Figure 3:
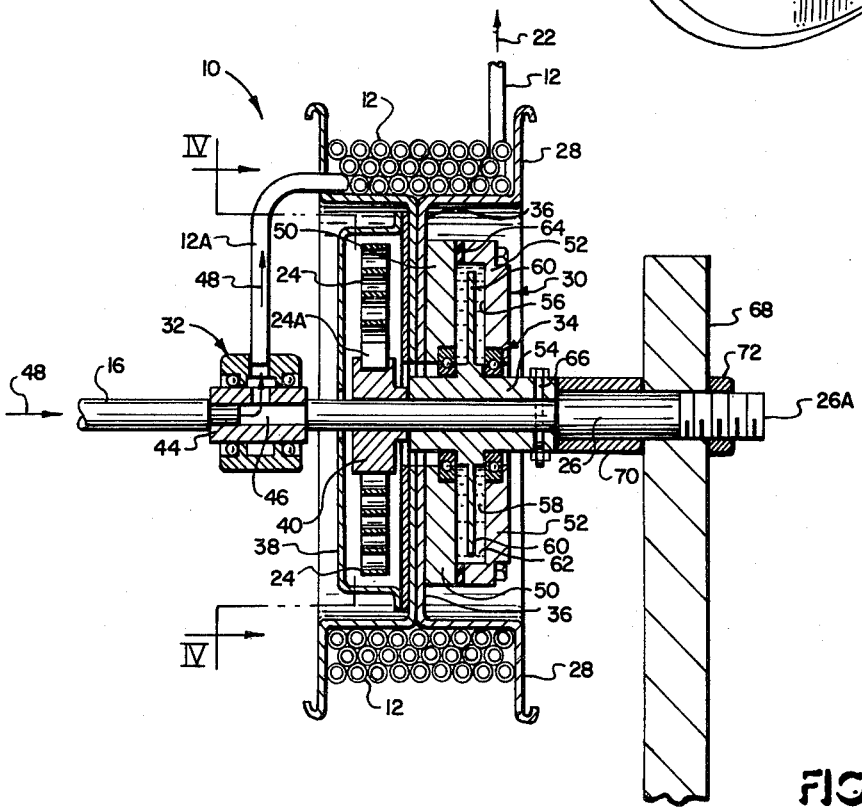
FIG. 3 is a longitudinal sectional view of the take-up reel assembly taken along the line III—III of FIG. 1; and, FIG. 4 is an elevation view, partly in section, taken along the line IV—IV of FIG. 3, which illustrates the placement of the wind-up spring motor within the take-up reel assembly.

Referring now to FIGS. 3 and 4, the take-up reel assembly 10 is supported by a rigid shaft 26. The principal components of the assembly are the wind-up spring 24, a take-up reel 28 around which the air hose 12 is stored, a viscous damper assembly 30, a high pressure rotary air seal 32 and a rotary viscous seal 34.

Figure 2:
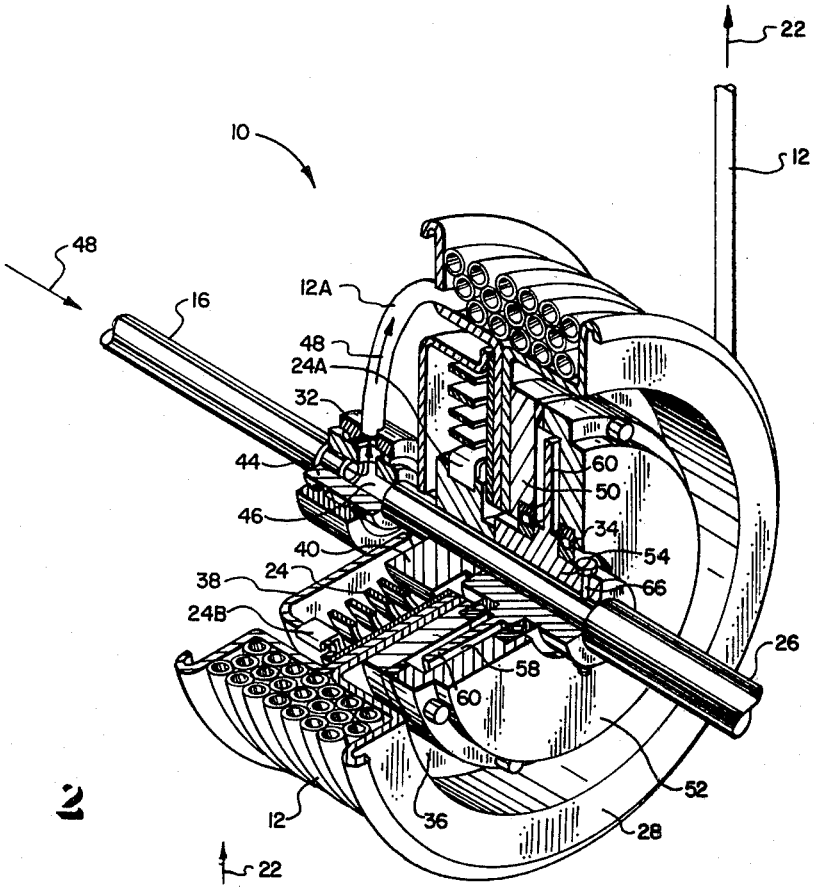
FIG. 2 is a perspective view, partially cut away, of a take-up reel assembly of the invention.

As can best be seen in FIGS. 2 and 3, the take-up reel 28 is supported in radially spaced relation with respect to the shaft 26 by means of a circular flange 36. The wind-up spring 24 is concentrically disposed about the support shaft 26 and is enclosed within a shroud 38. One end 24A of the wind-up spring 24 is mechanically attached to a hub 40 which is rigidly secured to the support shaft 26 by suitable means such as a set screw, key or spline (not illustrated). The opposite end 24B of the spring is secured to the shroud 38. According to this arrangement, the spring 24 is tightened in response to rotation of the take-up reel in the counterclockwise direction as indicated by the arrow 42. This corresponds with unwinding movement of the take-up reel 28 in which the air hose 12 is payed out.

Referring again to FIG. 3, one end of the support shaft 26 is provided with a coupling 44 having a bore 46 for admitting pressurized air. The underground conduit 16 is coupled to the fitting 44 in communication with the bore 46. High pressure air, as indicated by the arrow 48, is conducted through the conduit 16 into the fitting 44 and through the inlet end 12A of the air hose. The rotary air seal 32 is seated for rotary movement around the outside of the fitting 44. According to this arrangement, the inlet end 12A of the hose is free to rotate along with the take-up reel without interference.

Referring again to FIGS. 2 and 3, the take-up reel 28 and the support flange 36 are supported for rotation with respect to the support shaft 26 by the viscous damper assembly 30. According to this arrangement, the damper assembly 30 is formed by an annular back plate 50 and an annular cover plate 52, which are sealed against a rotor hub 54 by the rotary viscous seal 34. At least one of the damper plates, preferably the cover plate 52, is provided with a large annular counterbore 56 which in combination with the back plate 50 defines a damper chamber 58.

It will be appreciated that the damper chamber 58 can be formed by other back plate and cover plate configurations. For a compact assembly, the annular chamber arrangement as illustrated in FIGS. 2 and 3 is preferred. In this arrangement, maximum surface area is exposed for viscous shearing action.

According to an important feature of the invention, shearing action is provided by a stator disc 60 which is rigidly attached to the stator hub 54. The viscous seal 34 provides a rotary interface between the stator hub 54 and the damper back plates 50, 52. In this arrangement, the damper back plates also serve as a composit rotor hub. A volume of hydraulic fluid 62 is enclosed within the damper chamber 58. The cover plate 52 is sealed against the back plate 50 by an annular seal 64 so that the hydraulic fluid 62 is contained.

It will thus be seen that the entire assembly is supported by the shaft 26, and that the take-up reel 28, together with the damper assembly 30, rotate with respect to the support shaft 26. The stator hub 54 is rigidly secured to the support shaft 26 by any suitable means such as a lock pin 66. The entire assembly, together with the support shaft, is secured to the supporting structure 68. In this arrangement, the take-up reel assembly 10 is spaced with respect to the support structure 68 by a sleeve 70 which is interposed between the stator hub 54 and the support structure 68. The anchor end 26A of the support shaft 26 is threaded so that the entire assembly can be rigidly secured in place by a lock nut 72.

In operation, the hose 12 is unwound from the take-up reel and is pulled in the direction indicated by the arrow 22. When released, the rewind force developed by the wind-up spring motor 24 causes rotation of the take-up reel in a clockwise direction. As this occurs, the damper housing (50,52) rotates with respect to the stator disc 60. The rotation of the damper housing relative to the fixed stator gives rise to viscous friction forces which cause a conversion of the mechanical energy into shear or unavailable thermal energy.

Under the assumption that the movement of the fluid 62 relative to the surfaces of the damper housing is laminar, a force F is required to maintain the flow and slide the fluid layers relative to each other by overcoming the internal fluid resistance. If A represents the total area of the rotor and stator plates which are in contact with the fluid 62, then the shear stress is the ratio F/A. The rate of shearing of the fluid 62 is the ratio V/h, where h is the spacing between the plates. During each unit of time, there is an angular change equal to the ratio V/h. The viscosity of the hydraulic fluid is defined as dynamic viscosity (u), wherein (u) is a ratio of the shearing stress to the rate of shearing strain. From this definition, dynamic viscosity (u) is represented as follows:

$$(u) = \frac{F/A}{V/h}$$

From this relation, it is seen that:

$$F = \frac{(u)\ VA}{h}$$

It can be seen then that the shearing force F is directly proportional to viscosity, relative velocity of the surfaces, and the total surface area in contact with the fluid, and is inversely proportional to the thickness of the oil film. Because the surface area and the thickness of the oil film are fixed and the viscosity is substantially constant, the viscous retarding force which is developed in response to rotation of the take-up reel increases in direct proportion to the angular velocity of the take-up reel. It is this important relation which makes possible the strong retarding action which limits the terminal velocity of the hose as it is rewound, while allowing the hose to be pulled from the take-up reel freely without undue effort.

The foregoing detailed description has described a preferred embodiment of a hose reel having controlled rewind velocity. It should be understood, however, that the take-up reel assembly of the invention can be used to good advantage for paying out and taking up other flexible members such as lift cables, ropes, electrical cables, extension cords and grounding cords. In the foregoing detailed description, the preferred embodiment has been described in combination with a flexible pneumatic hose for purposes of illustration only, and it should be understood that various changes, substitutions and alterations can be made therein without departing from the spirit and scope of the invention as defined by the appended claims.

What is claimed is:

1. An air hose reel assembly comprising, in combination:

a support shaft having a passage for conducting air from a high pressure supply;

a take-up reel assembly concentrically aligned with said support shaft, said take-up reel assembly having a cylindrical rim on which air hose can be wound and having a radially projecting hub connected to said rim in such a way that said rim includes rim portions which extend axially with respect to the axis of rotation of said rim in opposite directions from said hub to form enclosed areas on each side of said hub;

a damper assembly interposed between said support shaft and one of said rim portions and disposed entirely within one of said areas formed by said one rim portion on one side of said hub, said damper assembly having a housing secured to said hub and defining an annular damper chamber in concentric, spaced relation with said support shaft, a stator member secured to said shaft and received within said damper chamber, and a volume of a viscous fluid contained within said damper chamber and surrounding said stator member;

a wind-up spring motor disposed between said support shaft and the other of said rim portions and entirely within the other of said areas formed by said other rim portion on the opposite side of said hub, said spring motor being coupled between said shaft and said hub on said opposite side of said hub;

rotary fluid sealing means for said damper chamber and supporting said take-up reel assembly for rotation on said shaft;

an air hose having an inlet end and a delivery end, said air hose being wound around said take-up reel; and, rotary fluid sealing means connecting said support shaft passage in fluid communication with the inlet end of said air hose.

2. The air hose reel assembly set forth in claim 1 wherein:

said damper housing comprises an annular back plate mounted on said hub in concentric relation with said support shaft, an annular cover plate mounted on said back plate in concentric relation with said support shaft, one of said plates having an annular counterbore disposed in concentric relation with said support shaft and defining said damper chamber, said stator member comprising an annular disc disposed within said counterbore in axially spaced relation between said back plate and said cover plate.

3. The air hose reel assembly set forth in claim 1 including:

a shroud member for said spring motor secured to said hub, said shroud member enclosing a torsion coil spring disposed around said support shaft and secured at one end to said shroud member and at its other end to a hub member nonrotatably supported on and with respect to said support shaft.

4. An air hose reel assembly comprising:

an elongated stationary support shaft mounted at one end to a supporting member and nonrotatable with respect to said supporting member;

a rotary damper assembly disposed on said support shaft including a stator member having a hub portion nonrotatably secured to said support shaft and a circular disc member projecting radially outward from said hub portion, and a housing portion rotatably disposed on said hub portion and disposed around said disc and defining a viscous fluid chamber;

a hose reel comprising a generally circular reel hub, a cylindrical hose supporting rim secured to the periphery of said reel hub and projecting axially with respect to the axis of said support shaft from opposite sides of said reel hub, said reel being secured to said housing portion at said reel hub and being rotatably supported on said damper assembly hub portion and wherein said damper assembly is disposed substantially entirely within a first area delimited by said rim and said reel hub;

a spring motor mounted on said support shaft and secured to the side of said reel hub opposite the side connected to said housing portion and disposed substantially entirely within a second area delimited by said rim and said reel hub; and a rotary fluid coupling supported on said shaft and disposed to be connected to a source of pressure air and to a flexible hose wound on said rim.

5. The air hose reel assembly set forth in claim 4 wherein:

said fluid coupling is spaced from said reel hub, said spring motor is interposed between said fluid coupling and said reel hub and an air hose is wound on said rim and is connected directly at one end to said fluid coupling.

6. An air hose reel assembly comprising:

a stationary support shaft;

a cylindrical hose reel adapted to be supported for rotation about said support shaft, said hose reel including a cylindrical peripheral rim for supporting a coil of flexible air hose;

a generally circular platelike hub portion of said rim having opposed mounting faces and extending in a plane perpendicular to an axis of rotation of said hose reel about said support shaft;

a viscous fluid rotary motion damper assembly including a hub member secured on said support shaft and a housing portion rotatable relative to said hub member and secured to one face of said hub portion of said rim for supporting said reel on said support shaft;

a rotary spring motor assembly including a hub member mounted on and secured to said support shaft, a shroud member secured to the opposite face of said hub portion of said rim and a wind up spring connected at one end to said hub member of said spring motor and at the other end to said shroud member; and a rotary fluid coupling disposed on said support shaft and operably connected to a source of pressure air and to a flexible air hose wound on said rim.

* * * * *